United States Patent [19]

Grantham et al.

[11] Patent Number: 4,526,677

[45] Date of Patent: Jul. 2, 1985

[54] REMOVAL OF POLYHALOGENATED BIPHENYLS FROM ORGANIC LIQUIDS

[75] Inventors: LeRoy F. Grantham, Calabasas; Joseph A. Ashworth, Northridge, both of Calif.

[73] Assignee: Rockwell International Corporation, El Segundo, Calif.

[21] Appl. No.: 616,837

[22] Filed: Jun. 4, 1984

[51] Int. Cl.[3] ..... C10G 21/16

[52] U.S. Cl. ..... 208/262; 174/14 R; 210/909

[58] Field of Search ..... 208/262; 174/14; 210/909

[56] References Cited

U.S. PATENT DOCUMENTS

| | | | |
|---|---|---|---|
| 2,203,690 | 6/1940 | Malm et al. | 210/62 |
| 3,862,900 | 1/1975 | Reusser | 208/262 |
| 3,881,295 | 5/1975 | Derby | 53/21 R |
| 3,894,171 | 7/1975 | Kusay | 174/14 R |
| 4,230,053 | 10/1980 | Deardorff et al. | 110/346 |
| 4,246,255 | 1/1981 | Grantham | 423/659 |
| 4,353,793 | 10/1982 | Brunelle | 208/262 |
| 4,353,798 | 10/1982 | Foss | 210/181 |
| 4,387,018 | 6/1983 | Cook et al. | 208/262 |
| 4,400,936 | 8/1983 | Evans | 60/274 |
| 4,447,262 | 5/1984 | Gay et al. | 75/65 R |

FOREIGN PATENT DOCUMENTS

| | | |
|---|---|---|
| 101847 | 5/1978 | Japan . |
| 785219 | 7/1980 | U.S.S.R. . |

*Primary Examiner*—Curtis R. Davis

*Attorney, Agent, or Firm*—H. Fredrick Hamann; Harry B. Field

[57] ABSTRACT

Polyhalogenated biphenyls such as PCB's, contained in transformer or capacitor oils, are removed from the transformer or capacitor oils by means of a combustible adsorbent which selectively adsorbs polyhalogenated biphenyls from transformer oils and the like. The adsorbent containing the adsorbed polyhalogenated biphenyls and the polyhalogenated biphenyls adsorbed thereon are destroyed by combustion in a molten salt.

14 Claims, 1 Drawing Figure

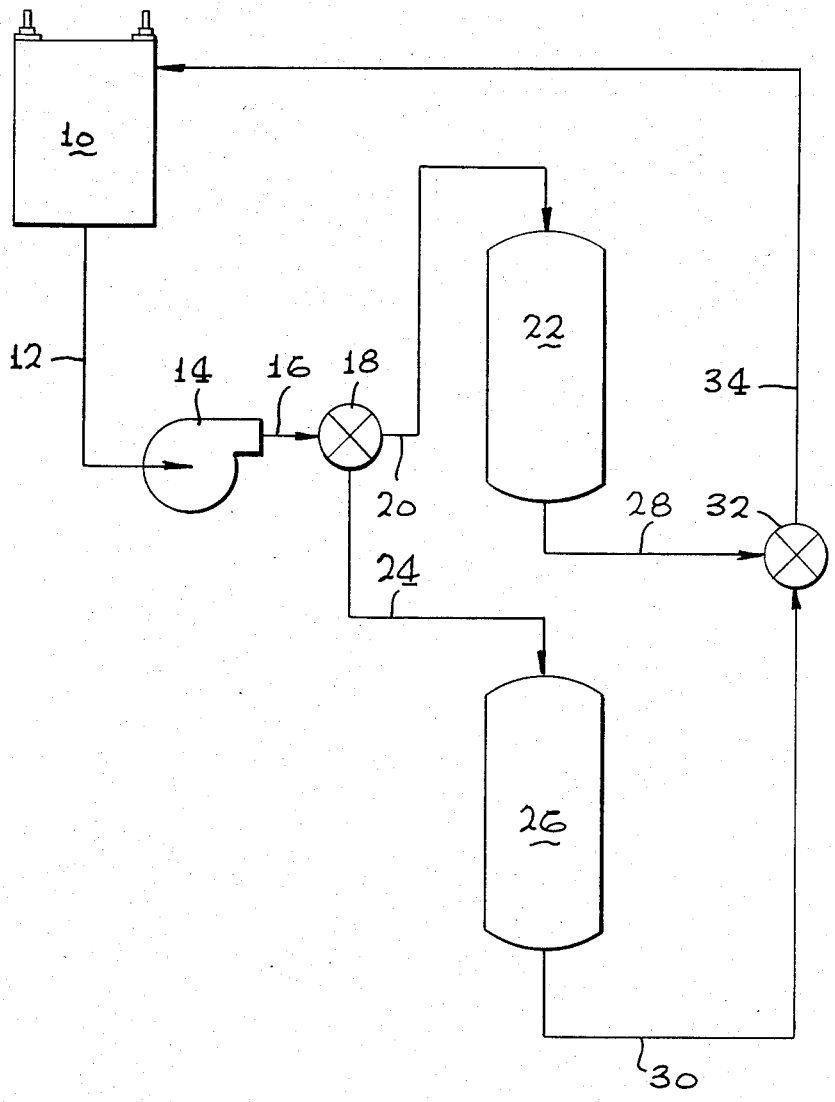
10
12
14
16
18
20
22
24
26
28
30
32
34

REMOVAL OF POLYHALOGENATED BIPHENYLS FROM ORGANIC LIQUIDS

BACKGROUND OF THE INVENTION

1. Field of the Invention

This invention relates to the removal of contaminants from organic liquids. In one of its more particular aspects it relates to the removal of halogenated aromatic hydrocarbons from oils. In another of its more particular aspects, this invention relates to the removal of polyhalogenated biphenyls such as polychlorinated biphenyls (PCB's) from oils used as dielectrics in electrical equipment and the destruction of the polyhalogenated biphenyls removed.

2. Prior Art

Polyhalogenated biphenyls, referred to hereinafter as PCB's, have been used in electrical equipment such as transformers and capacitors as non-flammable dielectrics. Since the discovery that PCB's were carcinogenic, teratogenic, and mutagenic, however, many transformers and capacitors formerly filled with PCB's have been drained and innocuous materials, such as highly refined mineral oils or silicone oils, substituted in their place. However, traces of polychlorinated biphenyls and other contaminants, such as polybrominated biphenyls (PBB's) remain in the oils as a result of incomplete cleaning of the equipment prior to substitution of the oils. Since the hazardous character of PCB's and similar materials has been determined to affect liquids contaminated with very small amounts of such materials, it has become necessary to purify such contaminated oils. Current Federal regulations require that any material contaminated with 500 ppm or more of PCB's must be handled, stored and disposed of by the same procedures as PCB's themselves. Materials contaminated with 50–500 ppm of PCB's are classified as PCB-contaminated materials and can be disposed of by burning in utility boilers of greater than 500,000,000-Btu/hr rated capacity. Materials containing less than 50 ppm of PCB's are classified as non-PCB materials and do not require extraordinary disposal procedures. Thus it is desirable to reduce the concentrations of PCB's in transformer oils and similar materials to below 500 ppm and preferably to below 50 ppm.

Processes for separating various types of halogen-containing compounds from liquids are known.

U.S. Pat. No. 2,203,690 discloses a process for removing water-immiscible liquids such as ethylene chloride from water-miscible liquids such as alcohols and ketones by diluting the mixture to be treated with water and passing the diluted mixture through activated carbon.

U.S. Pat. No. 3,862,900 discloses a process for adsorbing chlorine from hydrocarbons containing about 0.001 to 0.2 wt. % of chemically combined chlorine by passing the hydrocarbons through a bed of molecular sieves having an effective pore size in the range of 7 to 11 Angstrom units.

PCB's and PBB's in particular have been treated by various methods.

U.S. Pat. No. 3,881,295 discloses a process for disposing of PCB's and other chlorinated materials by means of a liquid swellable solid synthetic resinous polymer.

U.S. Pat. No. 4,230,053 discloses a process for destroying PBB's by means of a thermit reaction which utilizes an iron-containing waste byproduct from steel production, a mineral acid and a reducing metal such as aluminum, magnesium or manganese to provide temperatures of at least about 3000° F. (1650° C.).

U.S. Pat. No. 4,353,793 discloses the use of a mixture of a mono-capped polyalkylene glycol alkyl ether and an alkali metal hydroxide for reducing the level of PCB's dissolved in an organic solvent such as a transformer oil.

U.S. Pat. No. 4,353,798 discloses a process for removing PCB contaminants from silicone dielectric fluid by cooling a silicone dielectric fluid containing PCB contaminants to a temperature at which the resulting mixture separates into two phases, a silicone-rich phase and a PCB-rich phase. The PCB-rich phase is isolated by means of gravitational separation.

U.S. Pat. No. 4,387,018 discloses a process for removing PCB's from oil by extracting the PCB's into methanol.

U.S. Pat. No. 4,400,936 discloses a process for disposing of PCB's by subjecting them to combustion in a self-contained system utilizing a diesel engine or similar combustor which burns a mixture of fuel and PCB's. The system also utilizes liquid scrubbers for removing contaminants from the gases produced in the combustion. While the process of this invention effectively disposes of PCB's, it results in the combustion of a fuel along with the PCB's and requires the use of gas/liquid scrubbing apparatus.

PCB's have also been disposed of by decomposition in molten salts.

U.S. Pat. No. 4,246,255 discloses a process for the decomposition of PCB's using oxygen and a molten salt comprising an alkali metal carbonate and preferably also an alkali metal sulfate.

U.S. Pat. No. 4,447,262 discloses a process for the destruction of PCB's utilizing a molten salt comprising a mixture of a basic alkaline earth metal salt selected from the group consisting of alkaline earth metal oxides and carbonates together with an alkaline earth metal halide.

Processes are also known for removing contaminants from electrical equipment such as transformers.

U.S. Pat. No. 3,894,171 discloses the removal of sorbed water and gases from a transformer by means of a vacuum treatment which is carried out while the transformer is in operation.

Although various methods are known for removing halogenated hydrocarbons and especially PCB's and related materials from liquids contaminated therewith, none of the methods is wholly satisfactory for removing PCB's from transformer oils and similar materials which must be reclaimed for further use, none is completely acceptable for removing PCB's while the equipment containing them is in service and none is effective for destroying the PCB's in an economical manner after removal.

OBJECTS OF THE INVENTION

It is accordingly a principal object of the present invention to provide a process for removing PCB's from transformer oils and similar materials while the equipment containing them is in service.

Another object of this invention is to provide such a process which is capable of reducing the PCB levels in the oils to concentrations at which the oils may be classified as PCB-contaminated oils or non-PCB oils.

Another object of this invention is to provide a process for removing PCB's from organic materials in a manner such that the PCB's can be readily destroyed and the organic materials reused.

It is yet another object of this invention to provide a process which is inexpensive, convenient and readily adaptable to the treatment of PCB-contaminated materials which are contained in operating equipment.

Other objects and advantages of this invention will become apparent during the course of the following detailed description.

SUMMARY OF INVENTION

The present invention provides a process for the purification of organic liquids such as transformer oils and the like which are contaminated with polyhalogenated biphenyls. The process allows such purification to be accomplished while the equipment containing such organic liquids is in service. The process utilizes a combustible adsorbent which is selective for PCB's and similar materials. The adsorbent and the contaminant removed in the adsorption can be destroyed following adsorption of the contaminant. The process is readily adaptable to in situ cleanup of PCB-contaminated transformer or capacitor oils while the transformer or capacitor containing the PCB-contaminated oil is in service. If desired, however, the process can be conducted at a site removed from the site of the contaminated electrical equipment without interrupting the operation of such equipment. In this embodiment of the process a portion of the PCB-contaminared oil is removed from the electrical equipment in which it is contained and replaced with decontaminated oil. The oil is decontaminated at a remote location and then the decontaminated oil is returned to service at the site of the electrical equipment.

The invention comprises the steps of removing a portion of an organic liquid contaminated with polyhalogenated biphenyls from electrical equipment containing the organic liquid, contacting the portion removed with a combustible adsorbent to selectively adsorb polyhalogenated biphenyls from the portion removed, separating a partially purified portion of organic liquid from the adsorbent having polyhalogenated biphenyls adsorbed thereon and returning the partially purified portion of organic liquid to the electrical equipment. In a preferred embodiment, the adsorbent containing the polyhalogenated biphenyls and the polyhalogenated biphenyls adsorbed thereon are disposed of by destruction. In an especially preferred embodiment the adsorbent containing adsorbed PCB's and the PCB's adsorbed thereon are disposed of by destruction in a molten salt.

The process is advantageous because it can be used to remove PCB's from transformer or capacitor oils while the transformers or capacitors are in service and to dispose of the contaminating PCB's in a facile manner. A convenient method is thereby provided for removing PCB's and similar contaminants from such materials to low enough levels to reclassify such transformers or capacitors as PCB-contaminated or non-PCB equipment.

BRIEF DESCRIPTION OF THE DRAWING

The sole FIGURE of the drawing is a schematic flow diagram illustrating the use of the present invention in a continuous process to remove PCB's from a transformer which is in service.

DESCRIPTION OF THE PREFERRED EMBODIMENTS

In the process of the present invention an organic liquid such as an oil contaminated with PCB's or similar materials is treated to remove the PCB's from the oil in a manner such that the oil may be reused and the PCB's readily destroyed. In a particular embodiment of the present invention, the oil is thus treated while the transformer or capacitor in which it is used is in service, with the oil from which the PCB's have been removed being returned to service in the transformer or capacitor.

The process utilizes a combustible adsorbent such as an activated carbon adsorbent, which is selective for PCB's and similar materials. In general, any combustible adsorbent which is effective in adsorbing a nonionic material from an oil or other organic liquid in which it is contained as a contaminant may be used for this purpose. Those adsorbents which are most active and highly selective in the removal of PCB's and similar materials, such as activated charcoal, are most readily adapted for use in the present process. However, adsorbents which are less active and less selective, including other carbonaceous materials such as coconut charcoal, petroleum coke or devolatilized and activated coal may be used by subjecting the contaminated fluid to multiple treatments with the adsorbent. Polymeric carbonaceous materials having the desired PCB selectivity may also be used.

Contact between the PCB-contaminated oil and the adsorbent is most readily accomplished by passing the contaminated oil through a column containing the adsorbent. In this manner the contaminated oil contacts the adsorbent, the PCB's or other contaminants are adsorbed on the column and the oil from which the PCB's have been removed passes through the column and can be returned to service in a transformer or other electrical equipment.

The use of a series of columns permits the contaminated oil to be passed through one column and partially purified and the partially purified oil to then be passed through a second or additional columns in order to further purify the oil. In this manner, an oil of any desired purity can be obtained by utilizing as many columns as are required in order to achieve the desired results. Multiple columns also provide a means of switching the contaminated oil feed from a column of diminished adsorptive capacity due to adsorbed PCB's to a column containing fresh adsorbent. Thus, use of a plurality of columns enables continuous PCB removal without disrupting the operation of the equipment in which the contaminated oil is contained.

The particle size of the adsorbent is important in ensuring that the adsorbent is sufficiently selective or preferential to PCB's and similar contaminants. In general, the particle size may range from a maximum size of about 8 to 30 mesh, to a minimum of about 40 to 100 mesh, U.S. Standard Sieve size. A particularly preferred particle size is $-12$, $+40$ mesh. The pore size of the particles is also important in the present invention since it is desired to adsorb the PCB's from the oil while permitting the oil to pass through the particles of adsorbent. In general, a mean pore size in the range of about 10 to 150 Angstroms is useable with a mean pore size in the range of about 100 to 150 Angstroms being preferred.

The adsorbent is preferably prewetted or presoaked in order to ensure that the adsorption of PCB's from the contaminated oils will be most effective. Prewetting can be accomplished by treatment of the particles with an appropriate fluid. For example, the particles can be prewetted by passing a purified or partially purified oil from which some of the contaminant PCB's have been removed through a column of the adsorbent. Another method is to use the pure oil uncontaminated with PCB's or similar materials for this purpose. One reason for prewetting or presoaking the adsorbent is to assure that the adsorption of PCB's begins as soon as possible following the application of contaminated liquid to the adsorbent column. It has been found that if the adsorbent column is not prewetted a certain volume of contaminated oil is adsorbed by the column before any significant quantity of PCB's are removed from the oil by the column. Prewetting or presoaking the column prevents or minimizes the occurrence of this phenomenon. The preconditioned adsorbent, preferably in the form of an adsorbent column, is contacted with the liquid to be decontaminated at a rate such that the liquid is in contact with the adsorbent for a sufficient period of time to enable adsorption of the PCB contaminant from the liquid and flow of liquid containing a lower concentration of PCB from the adsorbent column. This rate is determined by the oil-adsorbent residence time, which depends upon the particular adsorbent used. In general, however, it has been found that it is desirable to utilize a residence time in the range of about 5 to 120 minutes and preferably about 15 to 60 minutes.

In general it is desired to reduce the concentration of PCB's in the contaminated fluid to a concentration below about 500 ppm and preferably below about 50 ppm. In tests conducted using activated charcoal having a particle size of 12×40 mesh and a pore size of 100–150 Angstroms, 50% of the PCB content of a transformer oil was removed after passage of 16 column volumes of PCB contaminated transformer oil through the activated charcoal.

The process of PCB removal is illustrated with respect to one embodiment thereof in the drawing. Referring to the drawing, transformer oil contaminated with PCB's is withdrawn from a transformer 10 via a conduit 12, and is pumped by means of a pump 14 through a conduit 16 to a three-way valve 18. Valve 18 permits contaminated transformer oil to be fed to either a first adsorption column 22 via a conduit 20 or to a second adsorption column 26 via a conduit 24 depending upon the position of valve 18. Continuous operation is achieved by feeding contaminated transformer oil to column 22 until the adsorptivity of column 22 is diminished to the point where no further appreciable adsorption occurs upon column 22, whereupon the PCB-saturated adsorbent is removed for disposal. The contaminated transformer oil from transformer 10 is then fed to column 26 by changing the position of valve 18 to permit contaminated transformer oil to flow through conduit 24 to column 26 while fresh adsorbent is being added to column 22. The purified transformer oils leave columns 22 or 26 by means of conduits 28 or 30, respectively, and are cycled via a valve 32 and a conduit 34 to transformer 10 for reuse.

The disposal of the PCB's adsorbed upon the column can be accomplished by introducing the adsorbent containing the adsorbed PCB's into a molten salt in accordance with the teachings of U.S. Pat. Nos. 4,246,255 and 4,447,262. The disclosures of U.S. Pat. Nos. 4,246,255 and 4,447,262 are incorporated herein by reference. The description of PCB's in U.S. Pat. No. 4,246,255 is applicable herein. According to the teachings of U.S. Pat. No. 4,246,255, the PCB's and a source of oxygen such as gaseous oxygen or air are fed into a reaction zone containing a molten salt mixture maintained at a temperature of about 700° to 1000° C. and preferably between about 850° and 950° C. The molten salt mixture comprises a major amount of an alkali metal carbonate or mixture of alkali metal carbonates and preferably includes a minor amount of an alkali metal sulfate. The PCB's are decomposed by pyrolysis and oxidation to form decomposition and combustion products including a gaseous effluent which consists essentially of carbon dioxide, water vapor, excess oxygen and, when the source of oxygen is air, nitrogen. According to the teachings of U.S. Pat. No. 4,447,262, the molten salt contains both a basic alkaline earth metal compound selected from the group consisting of alkaline earth metal oxides and carbonates and an alkaline earth metal halide.

Molten salt combustion of the combustible adsorbent used to remove the polyhalogenated biphenyls from the transformer or capacitor oil or other organic liquid contaminated with polyhalogenated biphenyls achieves facile disposal of both the adsorbent containing the adsorbed PCB's or other polyhalogenated biphenyls and the PCB's which are adsorbed upon the adsorbent. In this manner, the necessity for further treating the adsorbent to remove adsorbed PCB's therefrom is obviated and the PCB's and adsorbent are disposed of at the same time, making the process economical to operate.

Although any transformer or capacitor oil or similar organic liquid contaminated with polyhalogenated biphenyls can be treated in accordance with the process of the present invention, including hydrocarbon oils and silicone oils, it is preferred to treat contaminated hydrocarbon oils because it is possible thereby to realize more complete combustion of any hydrocarbon oil adsorbed upon the adsorbent than in the case of a silicone oil, the combustion of which results in formation of an inorganic ash in addition to the gaseous products mentioned above.

It will, of course, be realized that various modifications can be made to the design and operation of the process of this invention without departing from the spirit thereof. For example, adsorbents other than those specifically exemplified herein can be used, and other combinations of molten salts can also be utilized. Thus, while the principle, preferred design and mode of operation of the invention have been explained and what is now considered to represent its best embodiment has been illustrated and described, it is to be understood that, within the scope of the appended claims, the invention can be practiced otherwise than as specifically illustrated and described.

What is claimed is:

1. A process for the removal of polyhalogenated biphenyls from an organic liquid contained in electrical equipment which comprises:

removing from said electrical equipment a portion of an organic liquid contaminated with polyhalogenated biphenyls;

contacting said portion with a combustible carbon adsorbent to selectively adsorb polyhalogenated biphenyls from said portion;

separating a partially purified portion from the adsorbent having polyhalogenated biphenyls adsorbed thereon; and returning said partially purified portion to said electrical equipment.

2. A process according to claim 1 wherein the contacting and separating steps are accomplished by passing said portion of contaminated organic liquid through a column containing said adsorbent.

3. A process according to claim 1 wherein the adsorbent containing the adsorbed polyhalogenated biphenyls and the polyhalogenated biphenyls adsorbed thereon are disposed of by combustion in a molten salt comprising an alkali metal carbonate or an alkaline earth metal carbonate.

4. A process according to claim 1 wherein the polyhalogenated biphenyls comprise PCB's.

5. A process according to claim 1 wherein said adsorbent comprises activated charcoal.

6. A process according to claim 1 wherein said adsorbent has a mean pore size in the range of about 10 to 150 Angstroms.

7. Aprocess according to claim 1 wherein said organic liquid comprises an oil.

8. A process according to claim 1 wherein said organic liquid comprises a hydrocarbon oil.

9. A process according to claim 1 wherein said electrical equipment is a transformer or capacitor.

10. A process according to claim 1 wherein said electrical equipment is operating.

11. A process according to claim 1 wherein said partially purified portion contains less than about 500 ppm of polyhalogenated biphenyls.

12. A process according to claim 1 wherein said partially purified portion contains less than about 50 ppm of polyhalogenated biphenyls.

13. A continuous process for the removal of PCB's from a transformer oil contained in an operating transformer which comprises:

(a) removing from said operating transformer a first portion of transformer oil contaminated with PCB's;

(b) passing said first portion through a first column containing a carbon adsorbent to selectively adsorb PCB's from said first portion;

(c) returning a first partially purified portion to said transformer;

(d) removing from said operating transformer a further portion of transformer oil contaminated with PCB's;

(e) passing said further portion through said first column to selectively adsorb PCB's from said further portion;

(f) returning a further partially purified portion to said transformer;

(g) repeating steps(d), (e) and (f) a sufficient number of times, N, until the adsorptive capacity of said first column is diminished to the point where no further appreciable adsorption of PCB's can be effected by passing further portions of PCB-contaminated transformer oil through said first column;

(h) removing adsorbent of diminished adsorptive capacity from said first column and replacing with fresh carbon adsorbent;

(i) removing from said transformer an (N+1)th portion of transformer oil contaminated with PCB's;

(j) passing said (N+1)th portion through a second column containing fresh carbon adsorbent to selectively adsorb PCB's from said (N+1)th portion;

(k) returning the partially purified (N+1)th portion to said transformer;

(l) removing from said operating transformer a further portion of transformer oil contaminated with PCB's;

(m) passing said further portion through said second column to selectively adsorb PCB's from said further portion;

(n) returning a further partially purified portion to said transformer;

(o) repeating steps (l), (m) and (n) a sufficient number of times, M, until the adsorptive capacity of said second column is diminished to the point where no further appreciable adsorption of PCB's can be effected by passing further portions of PCB-contaminated transformer oil through said second column;

(p) removing adsorbent of diminished adsorptive capacity from said second column and replacing with fresh carbon adsorbent;

(q) alternately repeating steps (d), (e), (f), (g) and (h) and steps (l), (m), (n), (o) and (p) until the transformer oil in said transformer contains less than about 500 ppm of PCB's, and (r) disposing of the carbon adsorbent of diminished adsorptive capacity removed from said first or second column and the PCB's adsorbed thereon by combustion in a molten salt, the carbon adsorbent of diminished adsorptive capacity being removed from said first column during passage of portions of transformer oil through said second column and the carbon adsorbent of diminished adsorptive capacity being removed from said second column during passage of portions of transformer oil through said first column.

14. A process according to claim 13 wherein steps (d), (e), (f), (g) and (h) and steps (l), (m), (n), (o), and (p) are repeated alternately until the transformer oil in said transformer contains less than about 50 ppm of PCB's.

* * * * *